US008205468B2

(12) United States Patent
Hemminger et al.

(10) Patent No.: US 8,205,468 B2
(45) Date of Patent: Jun. 26, 2012

(54) THERMODYNAMIC CONTAINER

(75) Inventors: Orin L. Hemminger, Columbus, OH (US); Megan L. Cavanaugh, Columbus, OH (US); Brian E. Henslee, Galloway, OH (US)

(73) Assignee: ThermoBuffer LLC, Columbus, OH (US)

( * ) Notice: Subject to any disclaimer, the term of this patent is extended or adjusted under 35 U.S.C. 154(b) by 536 days.

(21) Appl. No.: 12/454,145

(22) Filed: May 13, 2009

(65) Prior Publication Data

US 2009/0283533 A1 Nov. 19, 2009

Related U.S. Application Data

(60) Provisional application No. 61/127,424, filed on May 13, 2008.

(51) Int. Cl.
*F25D 3/08* (2006.01)

(52) U.S. Cl. ..... 62/457.3; 62/457.6

(58) Field of Classification Search ..... 62/457.2, 62/457.3, 457.6, 371, 372; 220/592.17, 592.2, 220/592.25, 592.27, 254.5
See application file for complete search history.

(56) References Cited

U.S. PATENT DOCUMENTS

| | | | | |
|---|---|---|---|---|
| 2,876,634 | A | 3/1959 | Zimmerman et al. | |
| 3,096,897 | A * | 7/1963 | Hansen | 215/12.2 |
| 3,463,140 | A | 8/1969 | Rollor, Jr. | |
| 3,603,106 | A | 9/1971 | Ryan et al. | |
| 3,807,194 | A | 4/1974 | Bond | |
| 4,253,983 | A | 3/1981 | Blanie | |
| 4,765,393 | A | 8/1988 | Baxter | |
| 4,958,506 | A * | 9/1990 | Guilhem et al. | 62/457.2 |
| 5,052,369 | A * | 10/1991 | Johnson | 126/400 |
| 5,520,103 | A * | 5/1996 | Zielinski et al. | 99/483 |
| 5,601,744 | A * | 2/1997 | Baldwin | 219/689 |
| 5,709,105 | A * | 1/1998 | Palermo | 62/457.4 |
| 5,924,302 | A * | 7/1999 | Derifield | 62/457.2 |
| 5,987,913 | A * | 11/1999 | Andrzejczak | 62/457.2 |
| 6,044,650 | A * | 4/2000 | Cook et al. | 62/130 |
| 6,147,337 | A * | 11/2000 | Besser | 219/730 |
| 6,151,910 | A * | 11/2000 | Hazen | 62/457.2 |
| 6,634,417 | B1 | 10/2003 | Kolowich | |
| 6,968,888 | B2 | 11/2005 | Kolowich | |
| 7,059,387 | B2 | 6/2006 | Kolowich | |
| 2005/0218146 | A1 * | 10/2005 | Thissen | 220/592.28 |
| 2006/0156756 | A1 | 7/2006 | Becke | |
| 2007/0144703 | A1 * | 6/2007 | Kolowich | 165/10 |

* cited by examiner

*Primary Examiner* — Mohammad Ali

(74) *Attorney, Agent, or Firm* — Taft Stettinius & Hollister LLP

(57) ABSTRACT

A thermodynamic container for regulating the temperature of a liquid. An exemplary embodiment may include an inner layer of a thermal buffering material and an outer layer of insulation. The thermal buffering layer may include a phase change material and/or a non-phase change material. Some exemplary embodiments may include lid, which may include insulation, a thermal buffering layer, and/or a drinking port.

13 Claims, 11 Drawing Sheets

THERMODYNAMIC CONTAINER

CROSS REFERENCE TO RELATED APPLICATION

This application claims the benefit of U.S. Provisional Application No. 61/127,424, filed May 13, 2008, which is incorporated by reference.

BACKGROUND

The present disclosure is directed to containers for regulating the temperature of liquids and, more particularly, to thermodynamic containers including thermal buffering materials, which may include phase change materials and/or non phase change materials at the relevant operating temperatures.

SUMMARY

Exemplary embodiments may include thermodynamic containers for regulating the temperatures of liquids. An exemplary embodiment may include an inner layer of a thermal buffering material and an outer layer of insulation. The thermal buffering layer may include phase change and/or non-phase change materials. Some exemplary embodiments may include a lid, which may include insulation, a thermal buffering material (such as phase change and/or non phase change materials), and/or a drinking port.

In an aspect, a beverage container may include a cup portion including an interior for holding a beverage and an open top, where the cup portion includes an inner layer including a first portion of a thermal buffering material and an outer insulative layer; and a lid releasably engagable with the cup portion for covering the open top, the lid including a selectively sealable drinking port and a second portion of the thermal buffering material.

In a detailed embodiment, the thermal buffering material may include a phase change material, and the phase change material may have a melting point at approximately a predetermined desired beverage consumption temperature. In a detailed embodiment, the thermal buffering material may include a non phase change material. An exemplary non phase change material may not undergo a phase change in a desired operating temperature range.

In a detailed embodiment, the second portion of the thermal buffering material may be disposed in thermal contact with the drinking port. In a detailed embodiment, the lid may include a protrusion extending into the interior of the cup portion, and the second portion of the thermal buffering material may be disposed in the protrusion. In a detailed embodiment, the second portion of the thermal buffering material may include a phase change material. In a detailed embodiment, the second portion of the thermal buffering material may include a non-phase change material at the desired operating temperature. In a detailed embodiment, the cup portion may include a thermally conductive inner wall at least partially interposing the interior and the first portion of the thermal buffering material, a middle wall at least partially interposing the first portion of the thermal buffering material and the insulative layer, and an outer wall at least partially interposing the insulative layer and the ambient environment. In a detailed embodiment, the insulative layer may include any insulating layer, including but not limited to vacuum, air, and/or foam. In a detailed embodiment, the insulative layer may include foam. In a detailed embodiment, the insulative layer may include air.

In an aspect, a beverage container may include a cup portion including an interior for holding a beverage and an open top, where the cup portion includes an inner layer including a first portion of a thermal buffering material and an outer insulative layer; and a lid for covering the open top, the lid including a lid body releasably engagable with the cup portion proximate the open top, an open button extending upwardly from the body, a peg extending substantially axially through the body, a first end of the peg engaging the open button, a seal body mounted to a second end of the peg, the seal body releasably sealing against an annular rim on the lid body when the open button and the peg are in a closed position, and the seal body being axially spaced apart from the annular rim when the open button and the peg are in an open position, a spring arranged to bias the open button towards the closed position, and a drinking port selectively isolatable from the interior of the cup portion by the seal body and the annular rim.

In a detailed embodiment, a container may include a close button extending substantially radially from the lid body. A tab extending from the close button may be arranged to latch the open button in the open position and depressing the close button may release the tab from the open button.

In a detailed embodiment, the lid may include a second portion of the thermal buffering material. In a detailed embodiment, the second portion of the thermal buffering material may be disposed in a substantially annular shape within the lid body. In a detailed embodiment, the second portion of the thermal buffering material may be disposed in at least one of the seal body and the peg.

In a detailed embodiment, the lid may include a drinking indent proximate the drinking port. In a detailed embodiment, the cup portion may include a thermally conductive inner wall at least partially interposing the interior and the first portion of the thermal buffering material, a middle wall at least partially interposing the first portion of the thermal buffering material and the insulative layer, and an outer wall at least partially interposing the insulative layer and the ambient environment. In a detailed embodiment, the insulative layer may include a vacuum insulative layer. In a detailed embodiment, the insulative layer may include foam. In a detailed embodiment, the insulative layer may include air. In a detailed embodiment, the thermal buffering material may include a phase change material, and the phase change material may have a melting point at approximately a predetermined desired beverage consumption temperature. In a detailed embodiment, the thermal buffering material may include a non phase change material at the desired operating temperature.

In an aspect, a beverage container may include a cup portion including an interior for holding a beverage and an open top; and a lid releasably engagable with the cup portion for covering the open top, the lid including a selectively sealable drinking port and a first portion of a thermal buffering material.

In an detailed embodiment, the lid may include a protrusion extending into the interior of the cup portion, and the first portion of the thermal buffering material may be disposed in the protrusion. In a detailed embodiment, the cup portion may include a second portion of the thermal buffering material. In a detailed embodiment, the cup portion may include a thermally conductive inner wall at least partially interposing the interior and the second portion of the thermal buffering material, a middle wall at least partially interposing the second portion of the thermal buffering material and an insulative layer, and an outer wall at least partially interposing the insulative layer and the ambient environment. In a detailed embodiment, the insulative layer may include a vacuum insulative layer. In a detailed embodiment, the insulative layer may include air. In a detailed embodiment, a container may include at least one of a handle coupled to the cup portion and a grip at least partially encircling the cup portion. In a detailed embodiment, the thermal buffering material may include a phase change material, and the phase change material may have a melting point at approximately a predetermined desired beverage consumption temperature. In a detailed embodiment, the thermal buffering material may include a non phase change material.

In an aspect, a beverage container may include a cup portion including an interior for holding a beverage and an open top, where the cup portion includes an inner layer including a first portion of a thermal buffering material and an outer insulative layer; and a lid releasably engagable with the cup portion for covering the open top, the lid including a lid body an exit port, a hinge body pivotably affixed to the lid body, and a plug mounted to the hinge body, the plug being releasably engagable with the exit port when the hinge body is in a closed position, the plug being disengaged from the exit port when the hinge body is in an open position.

In a detailed embodiment, at least one of the hinge body, the plug, and the lid body may include a thermal buffering material. In a detailed embodiment, the thermal buffering material may include a phase change material. In a detailed embodiment, the thermal buffering material may include a non phase change material. In a detailed embodiment, the lid may include a protrusion extending into the interior of the cup portion, and the protrusion may include a thermal buffering material.

In an aspect, a beverage container may include a cup portion including an interior for holding a beverage and an open top, where the cup portion includes an inner layer including a first portion of a thermal buffering material and an outer insulative layer; and a lid releasably engagable with the cup portion for covering the open top, the lid including a selectively sealable drinking port and an insulative layer.

In a detailed embodiment, the cup portion may include a thermally conductive inner wall at least partially interposing the interior and the first portion of the thermal buffering material, a middle wall at least partially interposing the first portion of the thermal buffering material and the insulative layer, and an outer wall at least partially interposing the insulative layer and the ambient environment. In a detailed embodiment, the insulative layer may include a vacuum insulative layer. In a detailed embodiment, the insulative layer may include any insulating layer, including but not limited to air and/or foam. In a detailed embodiment, the lid may include a second portion of the thermal buffering material. In a detailed embodiment, the thermal buffering material may include a phase change material, and the phase change material may have a melting point at approximately a predetermined desired beverage consumption temperature. In a detailed embodiment, the thermal buffering material may include a non phase change material at the desired operating temperature.

BRIEF DESCRIPTION OF THE DRAWINGS

The detailed description refers to the following figures in which.

DETAILED DESCRIPTION

The present disclosure contemplates that maintaining and/or regulating the temperature of fluids may be useful in many industrial, residential, and/or consumer applications. For example, a consumer application of fluid temperature control may relate to beverages. In particular, hot beverages (such as coffee, tea, hot cocoa, and the like) may be too hot to drink immediately following preparation and may require some temperature adjustment prior to consumption. For example, some individuals may prefer to consume coffee at a temperature of approximately 140° F.-160° F. Notably, coffee may be brewed at approximately 205° F. and/or served at approximately 190° F., which may be too hot for consumption. Thus, a consumer may wait for the coffee to cool prior to consumption, and the cooling time may be significant if the coffee is contained in certain types of beverage containers, such as some vacuum insulated mugs. Additionally, it may be desirable to maintain a fluid at greater than ambient temperature. For example, it may be advantageous to maintain coffee above 140° F. for an extended period of time.

An exemplary beverage container according to the present disclosure may include a thermodynamic container which may quickly adjust the temperature of a hot beverage to near a desired temperature and which may maintain the temperature of the fluid near the desired temperature for an extended period of time.

Figure 1:
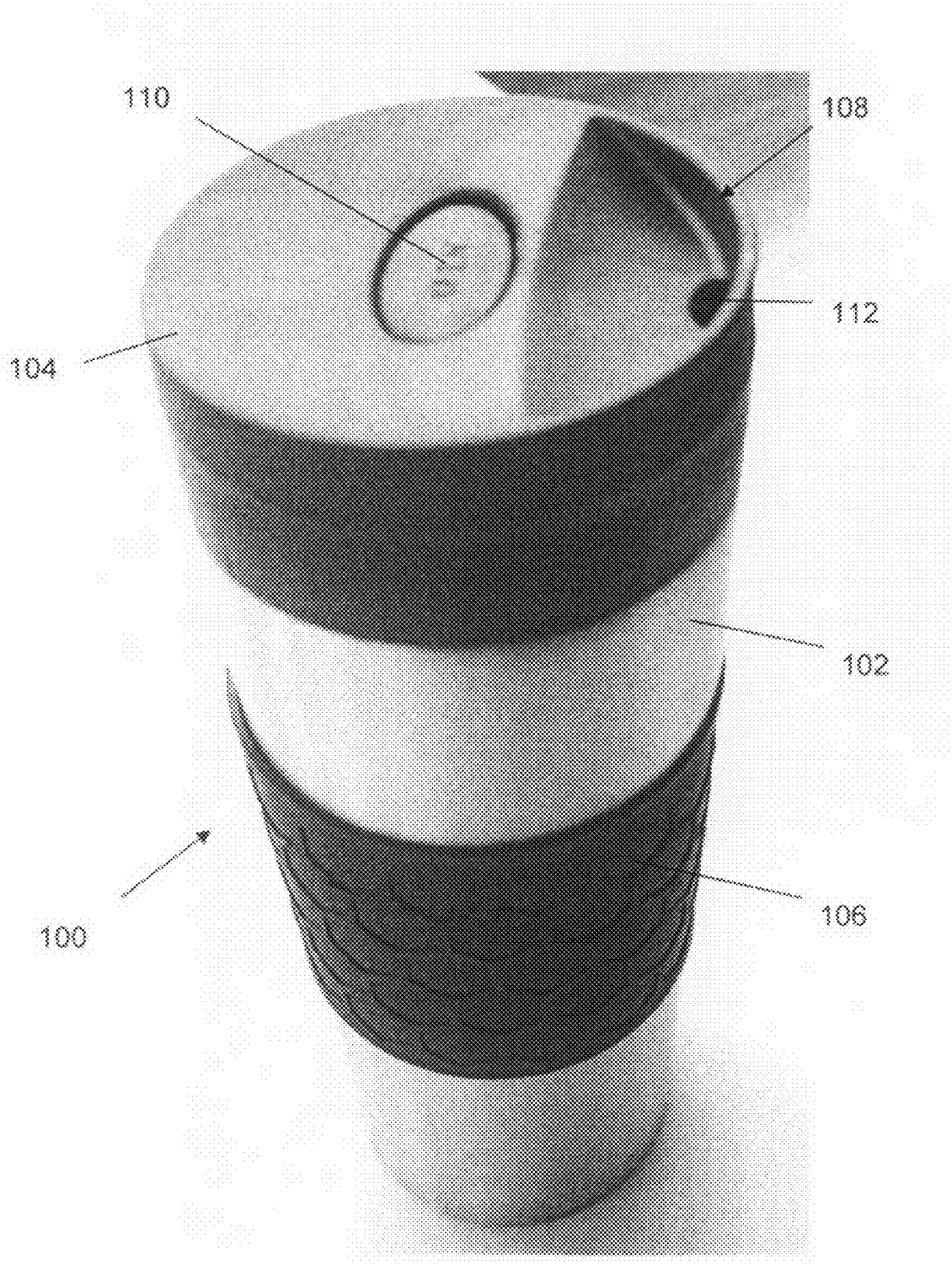
FIG. 1 is a perspective view of an exemplary travel mug according to the present disclosure.

FIG. 1 is a perspective view of an exemplary travel mug according to the present disclosure. An exemplary travel mug 100 may include a cup portion 102 and a removable lid 104. As discussed below, cup portion 102 and/or lid 104 may include one or more insulating layers and/or thermal buffering layers, such as a layer including a phase change material and/or a non phase change material. Cup portion 102 may include one or more surface features, such as a circumferential grip 106, which may be insulative and/or may provide improved gripping. Lid 104 may include a drinking indent 108 which may receive liquid from the interior of the cup portion 102 via drinking port 112. As discussed below, open button 110 may operate an assembly, which selectively seals and unseals drinking port 112 from the interior of cup portion 102.

Figure 2:
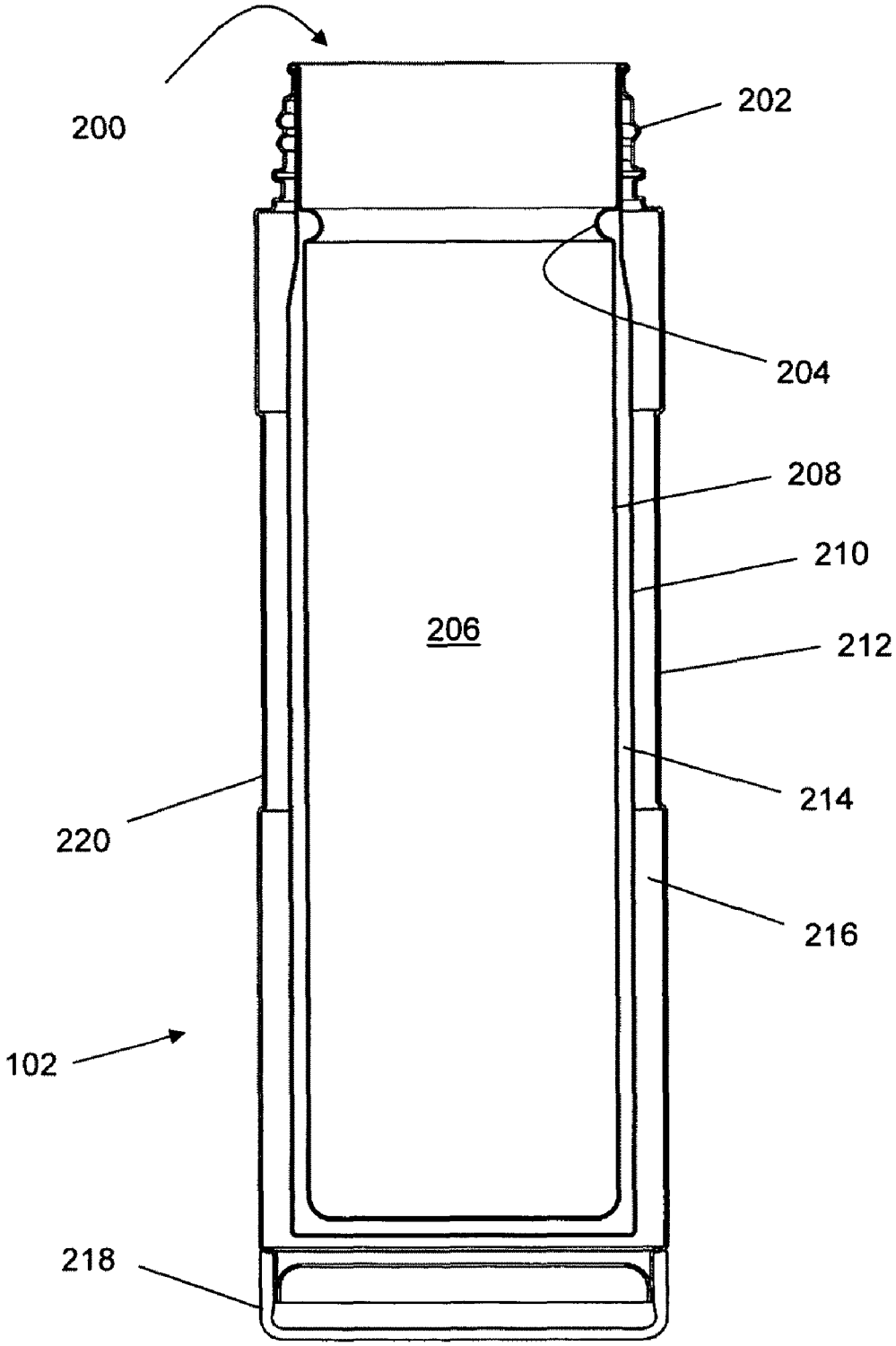
FIG. 2 is a cross-sectional view of a cup portion of an exemplary travel mug according to the present disclosure.

FIG. 2 is a cross-sectional view of a cup portion 102 of an exemplary travel mug 100 according to the present disclosure. An exemplary cup portion 102 may include an opening for receiving a lid, such as top opening 200. The opening 200 may be associated with a mechanical interface feature, such as threaded portion 202, for selectively coupling cup portion 102 to lid 104. The interior 206 of the cup portion 102 and/or the opening 200 may include a lid seal feature, such as projection 204 for sealingly engaging a portion of lid 104.

An exemplary triple-wall embodiment may include an inner wall 208, a middle wall 210, and an outer wall 212. A void located between inner wall 208 and middle wall 210 may be at least partially filled with one or more thermal buffering materials 214, such as a phase change material and/or a non phase change material. A void located between middle wall 210 and outer wall 212 may be filled with a thermally insulative material (such as, for example, air, foam, ceramic, and/or rubber) and/or may be evacuated to provide vacuum insulating layer 216. A bottom cap 218 may be mounted to a lower end of cup portion 102.

In some exemplary embodiments, walls 208, 210, 212 may be constructed from various metals (such as, for example, aluminum and/or stainless steel) and/or plastics, for example. Some exemplary embodiments may utilize a highly thermally conductive material (such as aluminum and/or stainless steel) for inner wall 208, and some exemplary embodiments may utilize less thermally conductive materials for other components, such as outer wall 212. In some exemplary embodiments, the inner wall 208 (and/or any other components which may directly contact the beverage) may be constructed from materials (such as aluminum and/or stainless steel) which will not impart an undesirable flavor and/or odor to the beverage. In some exemplary embodiments, the inner wall 208 may be constructed with fins (and/or other heat transfer enhancing features) protruding into the buffering layer or into the interior 206 of the cup portion 102.

In some exemplary embodiments, a thermal buffering material 214 may comprise a phase change material such as a material having a melting point in a desired temperature range. For example, a travel mug 100 designed to regulate the temperature of a beverage in the range of approximately 140° F.-160° F. may include a thermal buffering layer 214 comprising phase change material having a melting point of approximately 150° F. An exemplary embodiment may utilize bee's wax, paraffin, and/or naturally occurring fatty acids and/or heavy alcohols as a phase change material, for example. By varying the composition of the phase change material, a target temperature range of an exemplary travel mug 100 may be adjusted. For example and without limitation, phase change material compositions having melting points between approximately 120° F.-180° F. may be utilized to provide target temperatures in the range of approximately 120° F.-180° F.

In some exemplary embodiments, a thermal buffering layer 214 may comprise a non-phase change material such as a material having a high heat capacity in a desired temperature range. For example, a travel mug 100 designed to regulate the temperature of a beverage in the range of approximately 140° F.-160° F. may include a non-phase change material that remains a solid, liquid, or gas, dependent on the material, throughout the expected operating temperature range. An exemplary embodiment may utilize water, vegetable oil, glycol, and/or naturally occurring fatty acids and/or heavy alcohols, for example. The high heat capacity of the non-phase change thermal buffering material may act as a heat sink for receiving heat from the beverage. This may at first quickly lower the temperature of the beverage and subsequently provide a blanket of heated buffering material in thermal contact and/or at least partially surrounding the beverage.

Figure 3:
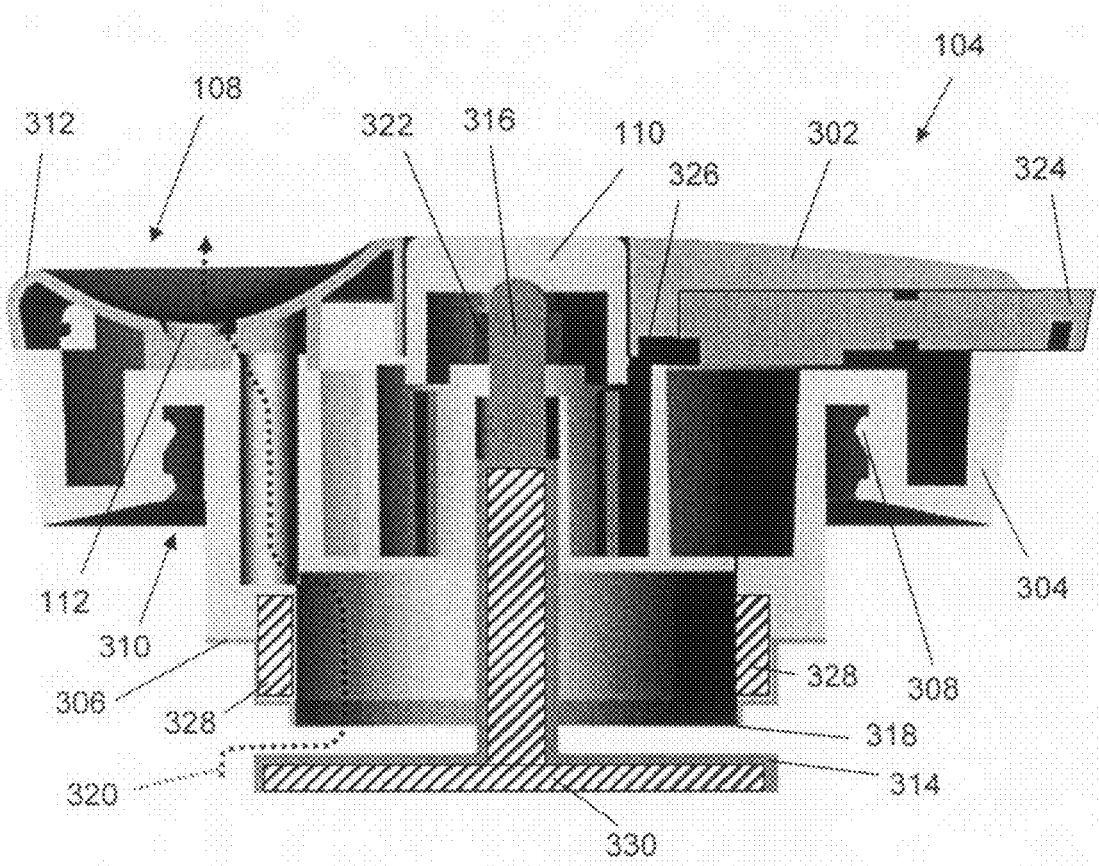
FIG. 3 is a cross-sectional view of a an exemplary lid for a travel mug.

FIG. 3 is a cross-sectional view of an exemplary lid 104 for a travel mug 100. An exemplary lid 104 may include a cap body 302 coupled to a mechanical body 304. The cap body 302 and/or the mechanical body 304 may be constructed from an insulative material, such as plastic. A gasket 306 may be provided on the lower end of the mechanical body 304 to provide a sealed interface between the lid 104 and the projection 204 of the cup portion 102. Threads 308 may be arranged to releasably engage threaded portion 202 of cup portion 102. In some exemplary embodiments, threads 308 may be disposed within a recessed annular slot 310 which may receive threaded portion 202 of cup portion 102. In some exemplary embodiments, a lid may couple with a cup portion by other methods, such as a screw fitting, snap fitting, press fitting, or swing top fitting including a swinging latch and/or a gasket, for example. An exemplary lid may include a drinking lip 312 near drinking indent 108 and/or drinking port 112.

In an exemplary embodiment, open button 110 may operate a seal body 314 via a peg 316. In an exemplary embodiment, depressing open button 110 (into an "open" position) may cause seal body 314 to disengage annular rim 318, thereby fluidicly connecting the interior of the cup portion 206 and drinking port 112. An exemplary flow path 320 from the interior 206 of the cup portion 102 through drinking port 112 is depicted with a dotted line in FIG. 3. When button 110 and peg 316 are in a non-depressed ("closed") position, seal body 314 may seal against annular rim 318, which may fluidicly isolate interior 206 of cup portion 102. Open button 110 may be biased towards its closed position by spring 322, which may at least partially encircle peg 316.

An exemplary lid 104 may include a close button 324 which may include a tab 326. In an exemplary embodiment, tab 326 may engage open button 110 as open button 110 is depressed into its open position. This may cause close button 324 to extend radially from lid 104 and may latch open button 110 in its open position, which may retain peg 316 and seal body 314 in their open positions. If the close button 324 is pressed radially inward (towards peg 316), tab 326 may release open button 110, which may allow spring 322 to move open button 110, peg 316, and seal body 314 into their closed positions.

An exemplary lid 104 may include a thermal buffering material, such as a phase change material and/or a non phase change material. As shown in FIG. 3, an exemplary lid 104 may include an annular ring 328 of thermal buffering material and/or a thermal buffering material 330 may be contained within portions of peg 316 and/or seal body 314. Thus, in some exemplary embodiments, the interior 106 of cup portion 102 may be substantially fully enclosed by thermal buffering material. In some exemplary embodiments, a thermal buffering material may be provided along portions of flow path 320.

Figure 4:
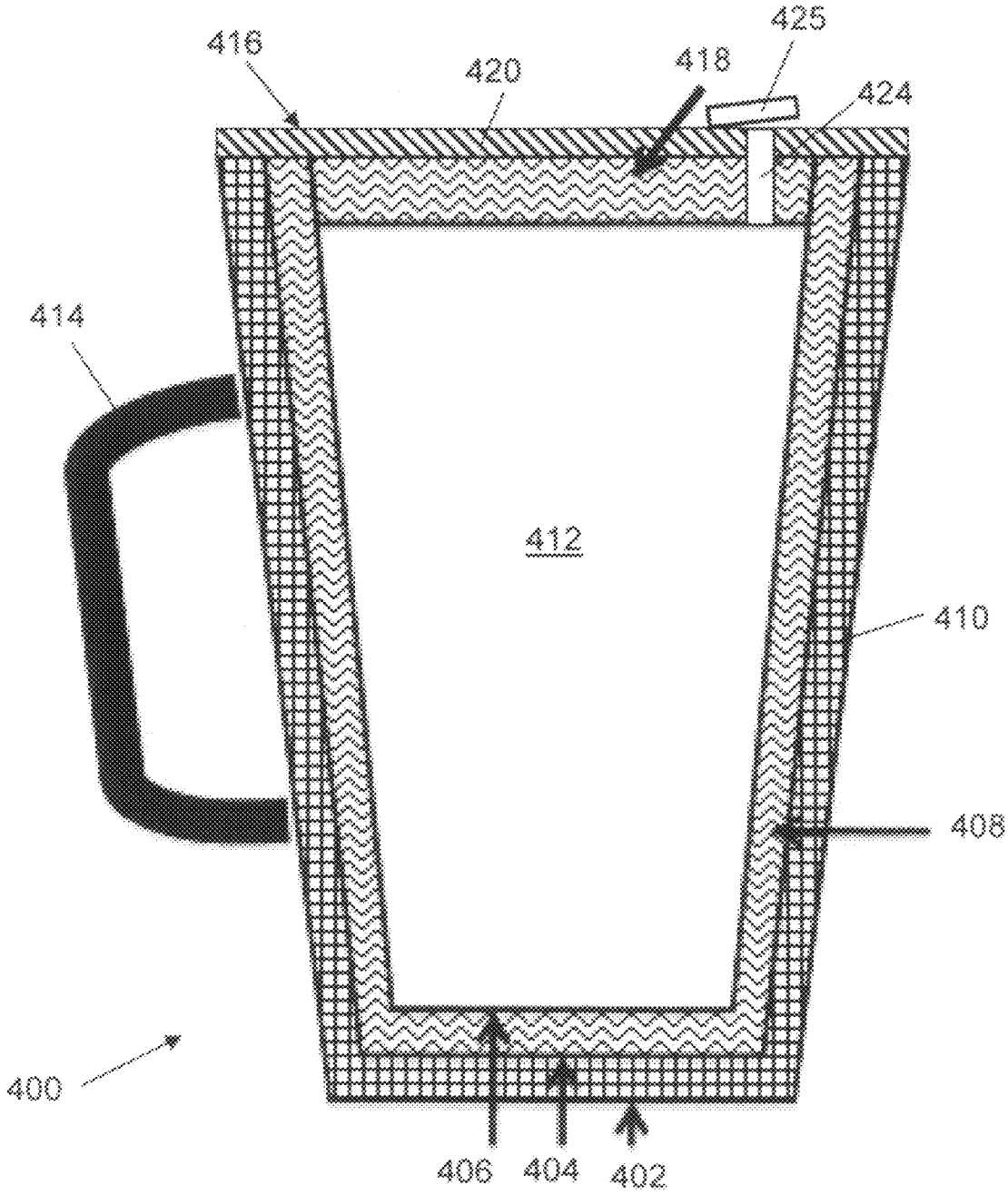
FIG. 4 is a cross-sectional diagram of an exemplary thermodynamic beverage container including a thermal buffering material in its lid which may be phase change or non-phase change at the desired operating temperature.

FIG. 4 is a cross-sectional diagram of an exemplary thermodynamic beverage container including a thermal buffering material, such as a phase change material and/or a non phase change material, in its lid. Exemplary beverage container 400 may include three walls: an outer wall 402, a middle wall 404, and an inner wall 406. The inner wall 406 and the middle wall 404 may be interposed by a phase change material 408 (and/or another thermal buffering material), and middle wall 404 and outer wall 402 may be interposed by insulation 410 (such as foam and/or a vacuum). Beverage container 400 may be arranged to hold a beverage in interior 412. Some exemplary embodiments may include a handle 414, which may be permanently attached or may be removable. An exemplary beverage container 400 may include a lid 416, which may include a drinking port 424 and/or a resealable drinking port seal 425. Lid 416 may include a phase change material 418 (and/or another thermal buffering material) and/or an insulating layer 420. In some exemplary embodiments, a lid 416 may be made of a metal (e.g., stainless steel and/or aluminum) and the buffering material may cool the lid surface to prevent burns when drinking. In some exemplary embodiments, insulating layer 420 may include a relatively non-thermally conductive portion of the lid 416 (e.g., a plastic portion) and/or insulating layer 420 may include foam and/or vacuum insulation, for example. It is within the scope of the disclosure to employ an insulating layer 420, components providing insulating effect (e.g., portions of cap body 302), and/or a phase change material 408, and/or a non phase change material (and/or another thermal buffering material) in a lid of any thermodynamic container. It is within the scope of the disclosure to utilize a handle 414 or a similar grasping feature on any thermodynamic container.

Figure 5:
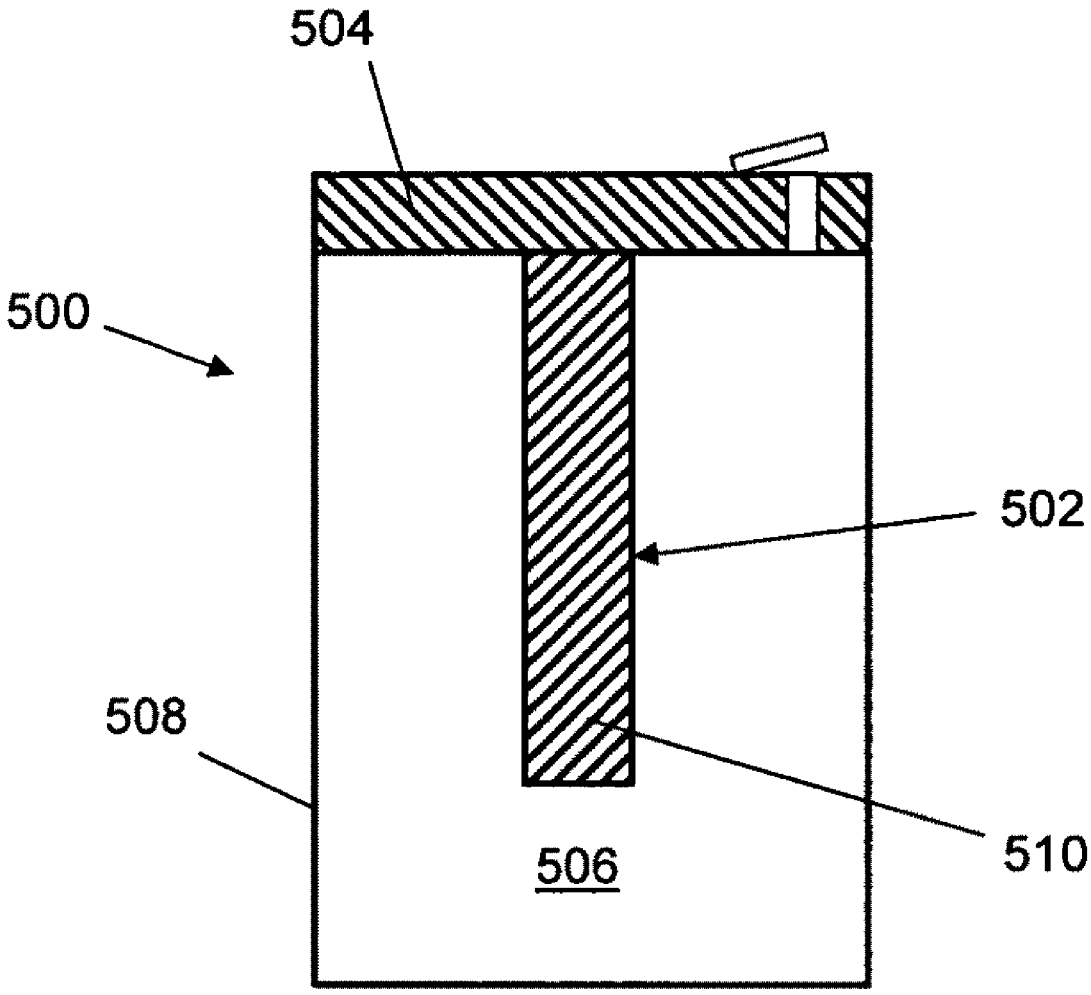
FIG. 5 is a cross-sectional diagram of an exemplary thermodynamic beverage container including a thermodynamic projection extending from its lid.

FIG. 5 is a cross-sectional diagram of an exemplary thermodynamic beverage 500 container which may include a thermodynamic projection 502 extending from its lid 504. Thermodynamic projection 502 may extend into the interior 506 of cup portion 508 and may be in thermal contact with a beverage contained therein. Thermodynamic projection 502 may include a thermal buffering material 510 (such as a phase change material and/or a non phase change material). Some exemplary embodiments may include fins or other heat transfer enhancing features on the surface or interior of thermodynamic projection 502. It is within the scope of the disclosure to utilize a thermodynamic projection extending in to the interior of any thermodynamic container, and the thermodynamic projection may extend from the lid, from the bottom of the cup portion, or from any other portion of the thermodynamic container. The thermodynamic projection may also be positioned in such a way that liquid may pass over the thermodynamic projection as it exits the container.

Figure 6:
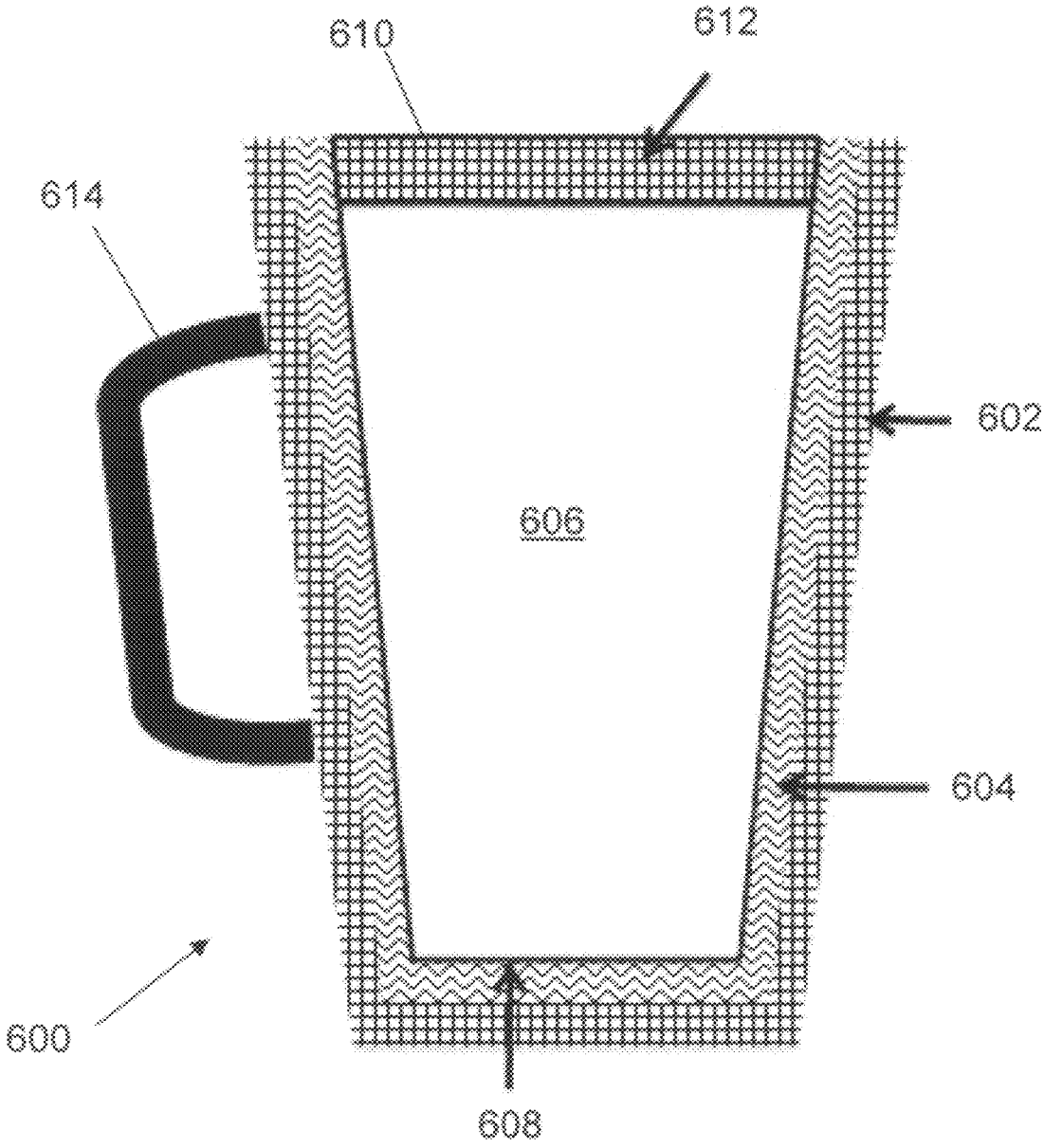
FIG. 6 is a cross-sectional diagram of an exemplary thermodynamic beverage container including a rigid insulating exterior.

FIG. 6 is a cross-sectional diagram of an exemplary thermodynamic beverage container 600 including a rigid insulating exterior 602. Beverage container 600 may include a thermal buffering material 604 (such as a phase change material and/or a non phase change material), which may be separated from the interior 606 of the container 600 by an inner wall 608. The container 600 may include a lid 610, which may include insulation or a thermal buffering material 612, and/or a handle 614. In some exemplary embodiments, the rigid insulating exterior 602 may be utilized in place of or in addition to one or more of the middle wall, the outer wall, and the insulating layer of other exemplary embodiments disclosed herein. In an exemplary embodiment, the rigid insulating layer may be constructed from a ceramic, rubber, hard plastic, and/or any material having good insulating properties, for example.

Figure 7:
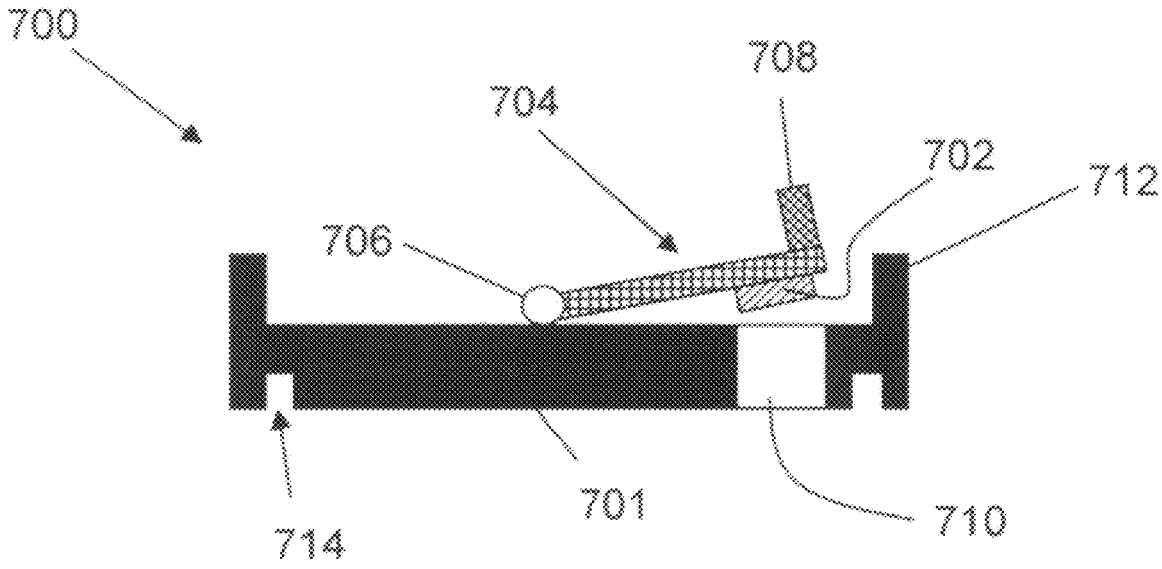
FIG. 7 is a cross-sectional view of an exemplary lid including a hinged plug.

FIG. 7 is a cross-sectional view of an exemplary lid 700 including a hinged plug 702. In an exemplary embodiment, plug 702 may be mounted to a hinge body 704, which may be connected to the lid body 701 by a hinge 706. An exemplary lid body 701 may include an exit port 710, a seal recess 714 for releasably and/or sealingly coupling to a beverage container cup portion, and a lid edge wall 712, which may at least partially surround the perimeter of the lid 700 and may catch excess or overflow liquid. An exemplary seal recess 714 may include a press fit with a gasket and/or a screw fit with gasket, for example. Hinge 706 may include, for example, a fastener and/or a shaft extending through portions of lid body 701 and/or hinge body 704. In some exemplary embodiments, hinge 706 may be provided as a snap fit of a portion of one of hinge body 704 and lid body 701 with a portion of the other. An exemplary hinge body 704 may include a hinge lever 708, which may be used to pivot hinge body 704 about hinge 706, thereby withdrawing plug 702 from an exit port 710 extending through lid body 701. Some exemplary hinge levers 708 may include non-slip textured and/or rubberized surfaces to enhance grip. In some exemplary embodiments, the hinge lever 708 may include a handle. In some exemplary embodiments, the hinge lever 708 may releasably engage lid edge wall 712 to latch the hinge body 702 with the plug 702 sealing the exit port 710. In some exemplary embodiments, plug 702 may be constructed from a flexible material, such as a rubberized material, to improve the seal against the exit port 710. An exemplary embodiment may be operated by pivoting plug 702 about hinge 706 into and out of engagement with exit port 710.

Figure 8:
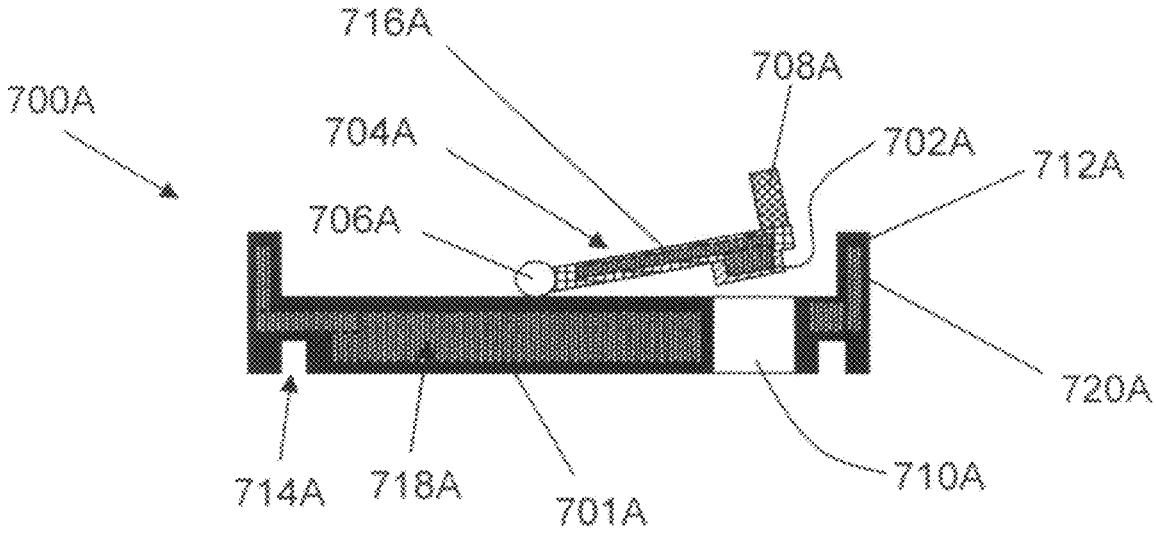
FIG. 8 is a cross-sectional view of an exemplary lid including a hinged plug and a thermal buffering material.

FIG. 8 is a cross-sectional view of an exemplary lid 700A including a hinged plug 702 A and thermal buffering materials. Exemplary lid 700A may be generally similar to exemplary lid 700, and may include a lid body 701A, a plug 702A, a hinge body 704A, a hinge 706A, a hinge lever 708A, an exit port 710A, a lid edge wall 712A, and/or a seal recess 714A. Exemplary lid 700A may also include thermal buffering materials (such as phase change materials and/or non phase change materials) at one or more locations. For example, hinge body 704A and/or plug 702A may include thermal buffering material 716A, lid body 701A may include thermal buffering material 718A, and/or lid edge wall 712A may include thermal buffering material 720A.

Figure 9:
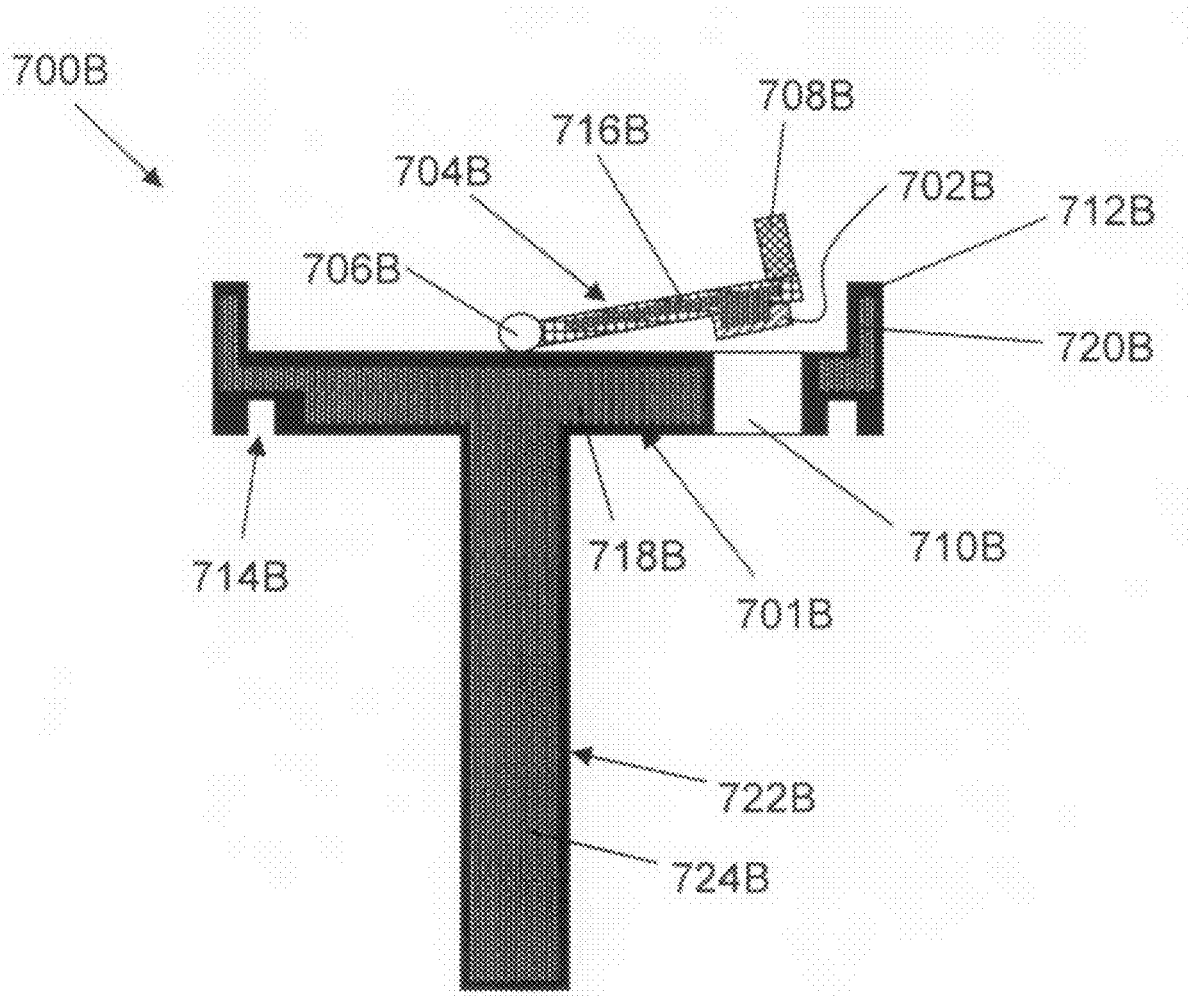
FIG. 9 is a cross-sectional view of an exemplary lid including a hinged plug and a thermal buffering protrusion.

FIG. 9 is a cross-sectional view of an exemplary lid 700B including a hinged plug and a thermal buffering protrusion. Exemplary lid 700B may be generally similar to exemplary lid 700, and may include a lid body 701B, a plug 702B, a hinge body 704B, a hinge 706B, a hinge lever 708B, an exit port 710B, a lid edge wall 712B, and/or a seal recess 714B. Exemplary lid 700B may also include thermal buffering materials (such as phase change materials and/or non phase change materials) at one or more locations. For example, hinge body 704B and/or plug 702B may include thermal buffering material 716B, lid body 701B may include thermal buffering material 718B, and/or lid edge wall 712B may include thermal buffering material 720B. Exemplary lid 700B may include a protrusion 722B arranged to extend into a beverage container to which the lid 700B is attached. The protrusion 722B may include in a thermal buffering material 724B, and/or may include fins or other heat transfer enhancing features on its interior and/or exterior surfaces.

Figure 10:
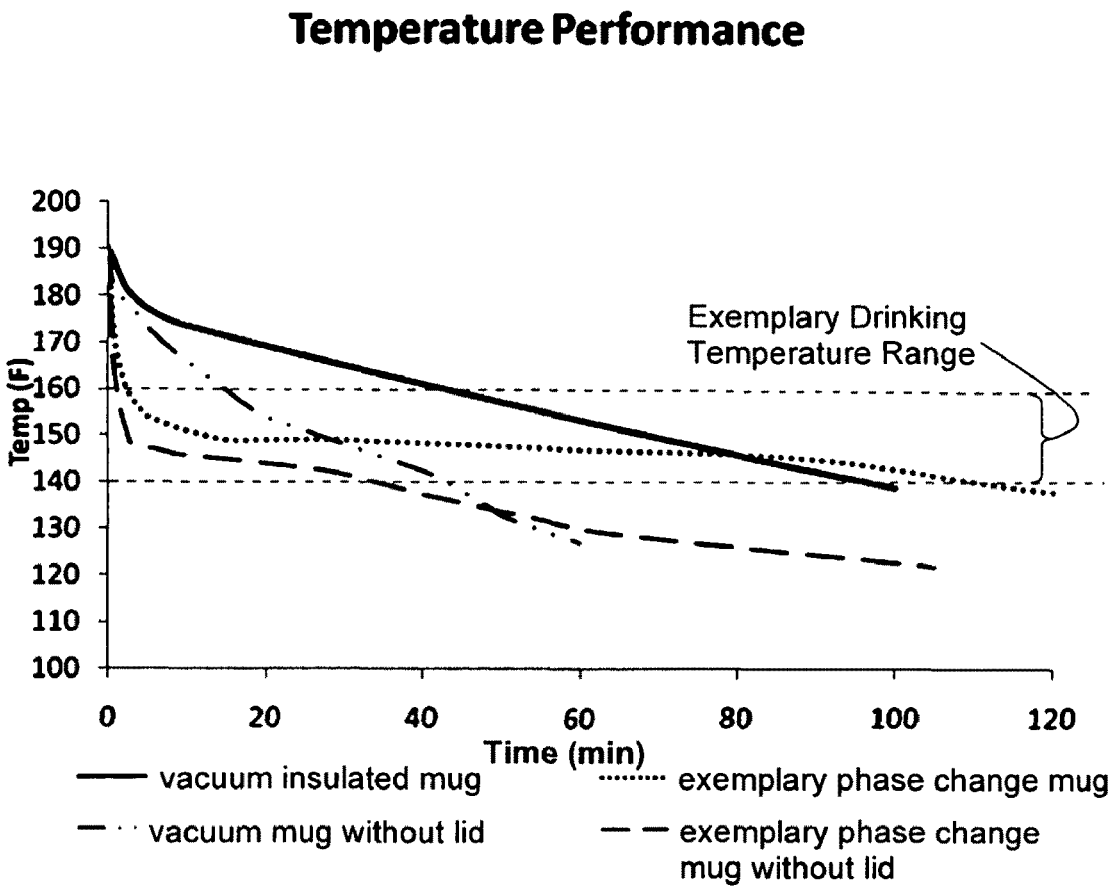
FIG. 10 is a plot of temperature versus time illustrating the performance of a vacuum insulated mug and an exemplary phase change mug, with and without lids.

FIG. 10 is a plot of temperature versus time illustrating the temperature performance of a vacuum insulated mug and an exemplary phase change mug, with and without lids. An exemplary method of using various embodiments described herein is described with reference to the dotted line labeled "exemplary phase change mug." A hot beverage at a relatively high temperature (e.g., 190° F.) may be poured into a mug, which may be at room temperature, and the lid may be installed. The phase change material, which may be a solid at room temperature, may absorb heat energy from the relatively hot beverage, thereby raising the temperature of the phase change material. Once the phase change material reaches its melting point, it may stop increasing in temperature while continuing to absorb heat energy from the beverage. In some exemplary embodiments, the temperature of the beverage may plateau as it reaches equilibrium with the phase change material at a temperature just above the melting point of the phase change material. In the example shown in FIG. 9, the temperature of the beverage plateaus at approximately 150° F. As heat energy is lost to the ambient environment, the beverage and the phase change material may begin to cool. The phase change material may release heat to the beverage as it solidifies, thereby maintaining the temperature of the beverage substantially constant at approximately the melting point of the phase change material. Thus, the temperature of the beverage may remain at approximately the melting point of the phase change material for an extended period of time. Once the phase change material has substantially completely solidified, the temperature of the beverage may decrease at a more rapid rate. When comparing lid and no lid situations the standard vacuum insulated flask increased its time in the desired range by a factor of approximately 2 while the thermodynamic container increased its time in the desired temperature range by a factor of approximately 3.25. The thermodynamic container with a lid may also greatly lengthen the time the container's temperature is in a stable plateau state. This highlights that the use of a lid to create a fully enclosed thermodynamic container may enhance the effects of the buffering material beyond what is expected.

Figure 11:
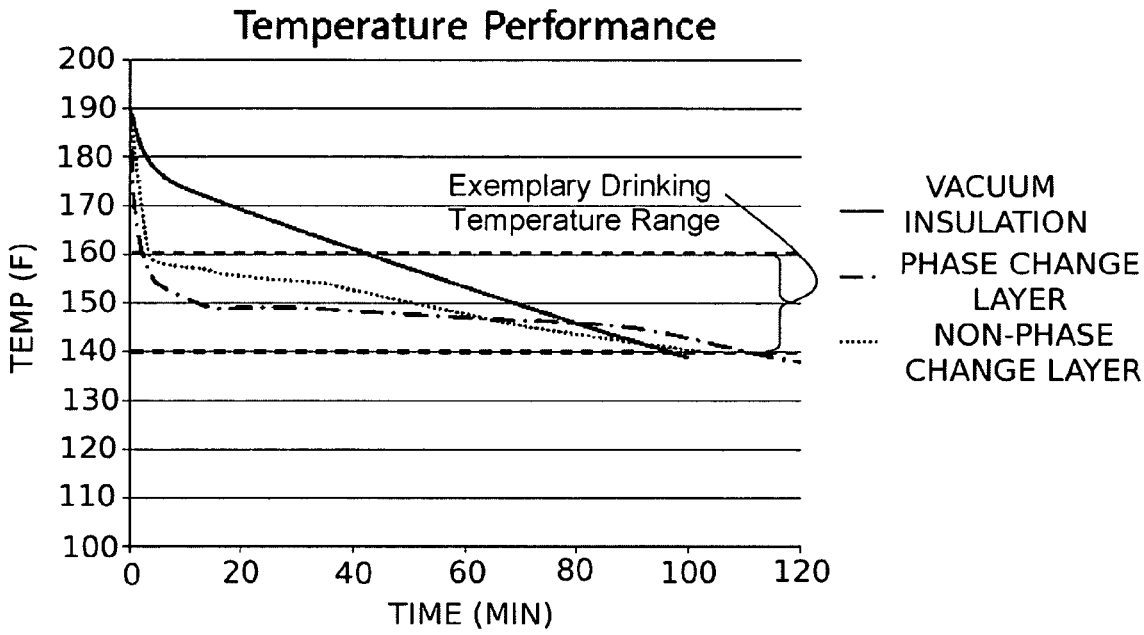
FIG. 11 is a plot of temperature versus time illustrating the performance of a vacuum insulated mug, an exemplary phase change mug, and an exemplary non phase change mug.

FIG. 11 is a plot of temperature versus time illustrating the performance of a vacuum insulated mug, an exemplary phase change mug, and an exemplary non phase change mug. As shown, the presence of a thermal buffering layer, phase change or non-phase change, may rapidly decrease the temperature of the contents initially. This may permit consumption of the beverage sooner compared to a mug with vacuum insulation only. The non-phase change layer may stabilize the temperature after the initial temperature drop and may then exhibit a steady, substantially linear decline in temperature until out of the exemplary drinking temperature range (outlined by the dashed lines at 140° F. and 160° F.). The phase change layer in contrast may have a longer steady temperature profile region after the initial temperature drop before entering its linear decrease out of the exemplary drinking temperature range. While the use of a phase change material for the thermal buffering layer may have slightly better thermal performance compared to the use of a non phase change material for the thermal buffering layer, the non phase change material may have cost and/or manufacturing advantages that may make it an attractive option for thermal control.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages of the may exist even though they may not have been explicitly discussed herein.

What is claimed is:

1. A beverage container comprising:

a cup portion including an interior for holding a beverage and an open top, where the cup portion includes an inner layer including a first portion of a thermal buffering material and an outer insulative layer; and a lid for covering the open top, the lid including a lid body releasably engagable with the cup portion proximate the open top, an open button extending upwardly from the body, a peg extending substantially axially through the body, a first end of the peg engaging the open button, a seal body mounted to a second end of the peg, the seal body releasably sealing against an annular rim on the lid body when the open button and the peg are in a closed position, and the seal body being axially spaced apart from the annular rim when the open button and the peg are in an open position, a spring arranged to bias the open button towards the closed position, and a drinking port selectively isolatable from the interior of the cup portion by the seal body and the annular rim.

2. The container of claim 1, further comprising a close button extending substantially radially from the lid body; wherein a tab extending from the close button is arranged to latch the open button in the open position; and wherein depressing the close button releases the tab from the open button.

3. The container of claim 1, wherein the lid includes a second portion of the thermal buffering material.

4. The container of claim 3, wherein the second portion of the thermal buffering material is disposed in at least one of the seal body and the peg.

5. The container of claim 1, wherein the cup portion includes a thermally conductive inner wall at least partially interposing the interior and the first portion of the phase change material, a middle wall at least partially interposing the first portion of the phase change material and the insulative layer, and an outer wall at least partially interposing the insulative layer and the ambient environment.

6. The container of claim 1, wherein the thermal buffering material includes a phase change material; and wherein the phase change material has a melting point at approximately a predetermined desired beverage consumption temperature.

7. The container of claim 1, wherein the thermal buffering material includes a non phase change material in a desired operating range.

8. A beverage container comprising:

a cup portion including an interior for holding a beverage and an open top; and a lid releasably enlargeable with the cup portion for covering the open top, the lid including a selectively sealable drinking port and a first portion of a thermal buffering material ; wherein the lid includes a protrusion extending into the interior of the cup portion; and wherein the first portion of the thermal buffering material is disposed in the protrusion.

9. The container of claim 8, wherein the cup portion includes a second portion of the thermal buffering material.

10. The container of claim 9, wherein the cup portion includes a thermally conductive inner wall at least partially interposing the interior and the second portion of the thermal buffering material, a middle wall at least partially interposing the second portion of the thermal buffering material and an insulative layer, and an outer wall at least partially interposing the insulative layer and the ambient environment.

11. The container of claim 10, wherein the insulative layer includes a vacuum insulative layer.

12. The container of claim 8, wherein the thermal buffering material includes a phase change material; and wherein the phase change material has a melting point at approximately a predetermined desired beverage consumption temperature.

13. The container of claim 8, wherein the thermal buffering material includes a non phase change material.

* * * * *